US010502032B2

(12) United States Patent
Greci et al.

(10) Patent No.: US 10,502,032 B2
(45) **Date of Patent: *Dec. 10, 2019**

(54) FLOW DISTRIBUTION ASSEMBLIES FOR DISTRIBUTING FLUID FLOW THROUGH SCREENS

(71) Applicant: Halliburton Energy Services, Inc., Houston, TX (US)

(72) Inventors: Stephen Michael Greci, Little Elm, TX (US); Jean-Marc Lopez, Plano, TX (US); Michael Fripp, Carrollton, TX (US); John Charles Gano, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/373,486

(22) Filed: Apr. 2, 2019

(65) Prior Publication Data

US 2019/0226304 A1 Jul. 25, 2019

Related U.S. Application Data

(63) Continuation of application No. 14/412,061, filed as application No. PCT/US2014/014829 on Feb. 5, 2014, now Pat. No. 10,294,762.

(51) Int. Cl.

| | |
|---|---|
| ***E21B 43/08*** | (2006.01) |
| *E21B 33/12* | (2006.01) |
| *E21B 43/14* | (2006.01) |

(52) U.S. Cl.

CPC ..... *E21B 43/086* (2013.01); *E21B 43/088* (2013.01); *E21B 33/12* (2013.01); *E21B 43/14* (2013.01)

(58) Field of Classification Search

CPC ..... E21B 43/088; E21B 43/086

See application file for complete search history.

(56) References Cited

U.S. PATENT DOCUMENTS

| | | | |
|---|---|---|---|
| 5,918,672 | A | 7/1999 | McConnell et al. |
| 6,830,104 | B2 | 12/2004 | Nguyen et al. |
| 8,127,831 | B2 | 3/2012 | Haeberle et al. |
| 2004/0134656 | A1 | 7/2004 | Richards |

(Continued)

FOREIGN PATENT DOCUMENTS

| | | | |
|---|---|---|---|
| WO | 2012135306 | A2 | 10/2012 |
| WO | 2015119599 | A1 | 8/2015 |

OTHER PUBLICATIONS

International Search Report and Written Opinion dated Nov. 7, 2014; International PCT Application No. PCT/US2014/014829.

*Primary Examiner* — Kristyn A Hall

(74) *Attorney, Agent, or Firm* — McGuireWoods LLP

(57) ABSTRACT

Embodiments herein include an assembly comprising a base pipe having at least one flow port defined therein; a well screen arranged about the base pipe and in fluid communication with the at least one flow port, the well screen having an end disposed at or near the at least one flow port; a shroud arranged about the end of the well screen and extending axially along a length of the well screen; and an annular gap defined between the well screen and the shroud and configured to receive a flow of a fluid, wherein the shroud increases a flow resistance of the fluid by channeling the fluid across the annular gap to distribute a flow energy of the fluid over the length of the well screen.

20 Claims, 5 Drawing Sheets

(56) References Cited

U.S. PATENT DOCUMENTS

| | | | |
|---|---|---|---|
| 2011/0180257 | A1 | 7/2011 | Scott et al. |
| 2012/0152528 | A1 | 6/2012 | Greci |
| 2013/0000889 | A1 | 1/2013 | Bonner et al. |

FLOW DISTRIBUTION ASSEMBLIES FOR DISTRIBUTING FLUID FLOW THROUGH SCREENS

CROSS-REFERENCE TO RELATED APPLICATIONS

This application is a continuation of U.S. patent application Ser. No. 14/412,061 filed on Dec. 30, 2014, which is a 371 application of International application no. PCT/US2014/014829, filed Feb. 5, 2014 both of which are incorporated herein by reference.

BACKGROUND

The present disclosure generally relates to downhole fluid flow control and, more particularly, to flow distribution assemblies for use in distributing fluid flow through well screens.

In hydrocarbon production wells, it is often beneficial to regulate the flow of formation fluids from a subterranean formation into a wellbore penetrating the same. A variety of reasons or purposes can necessitate such regulation including, for example, preventing water and/or gas coning, minimizing water and/or gas production, minimizing sand production, minimizing oil production, balancing production from various subterranean zones, equalizing pressure among various subterranean zones, and/or the like.

A number of flow control devices are available for regulating the flow of formation fluids. Some of these devices may be non-discriminating for different types of formation fluids and can simply function as a "gatekeeper" for regulating access to the interior of a wellbore pipe, such as production tubing. Such gatekeeper devices can be simple flow control orifices, nozzles, or on/off valves, or they can be metered to regulate fluid flow over a continuum of flow rates. Such flow control devices are referred to as inflow control devices ("ICD"). Other types of flow control devices can achieve at least some degree of discrimination between different types of formation fluids. Such flow control devices are referred to as autonomous inflow control devices ("AICD").

Flow control devices may be arranged or otherwise mounted on a base pipe (e.g., production tubing) adjacent a well screen disposed about the base pipe to control the flow of fluid between the exterior and interior of the base pipe. The base pipe may be placed within a wellbore, thereby forming an annulus between the wellbore and the outer diameter of the well screen. During production, formation fluids within the annulus are drawn into the base pipe through the well screen and any flow control devices associated therewith.

The fluids drawn into the well screens will tend to follow the path of least resistance. When a flow control device is placed at the end of a well screen, the path of least resistance for the fluid is to enter the well screen immediately next or closest to the flow control device. As can be appreciated, this can cause very high fluid velocities in the last few inches of the well screen. The actual fluid velocity through the well screen may be dependent upon a number of factors including, but not limited to, the viscosity of the fluid, the gauge of the screen, the type of flow control device used, the size of the flow channel beneath the well screen, and whether the annulus is gravel packed.

The dramatic increase in fluid velocity at the end of the well screen adjacent a flow control device may result in harmful erosion or deformation to the well screen at that location. Such erosion or deformation may ultimately cause the well screen to fail, thereby allowing formation or sand particulates to be produced with desired formation fluids (e.g., hydrocarbons).

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure generally relates to downhole fluid flow control and, more particularly, to flow distribution assemblies for use in distributing fluid flow through well screens.

Disclosed are various embodiments of flow distribution assemblies including a flow control shroud that may be mounted about a well screen disposed about a base pipe. The embodiments herein aid in axially distributing the fluid velocity of fluids passing through the well screen, thereby more evenly distributing the flow. By axially distributing the velocity of the fluids through the well screen, particulates or other abrasive components entrained in the fluids are less likely to erode or damage the well screen at typical points of increased velocity. Thus, the flow distribution assemblies may be advantageous in prolonging the useful life of the well screen and positively impacting economic production and efficiency.

Figure 1:
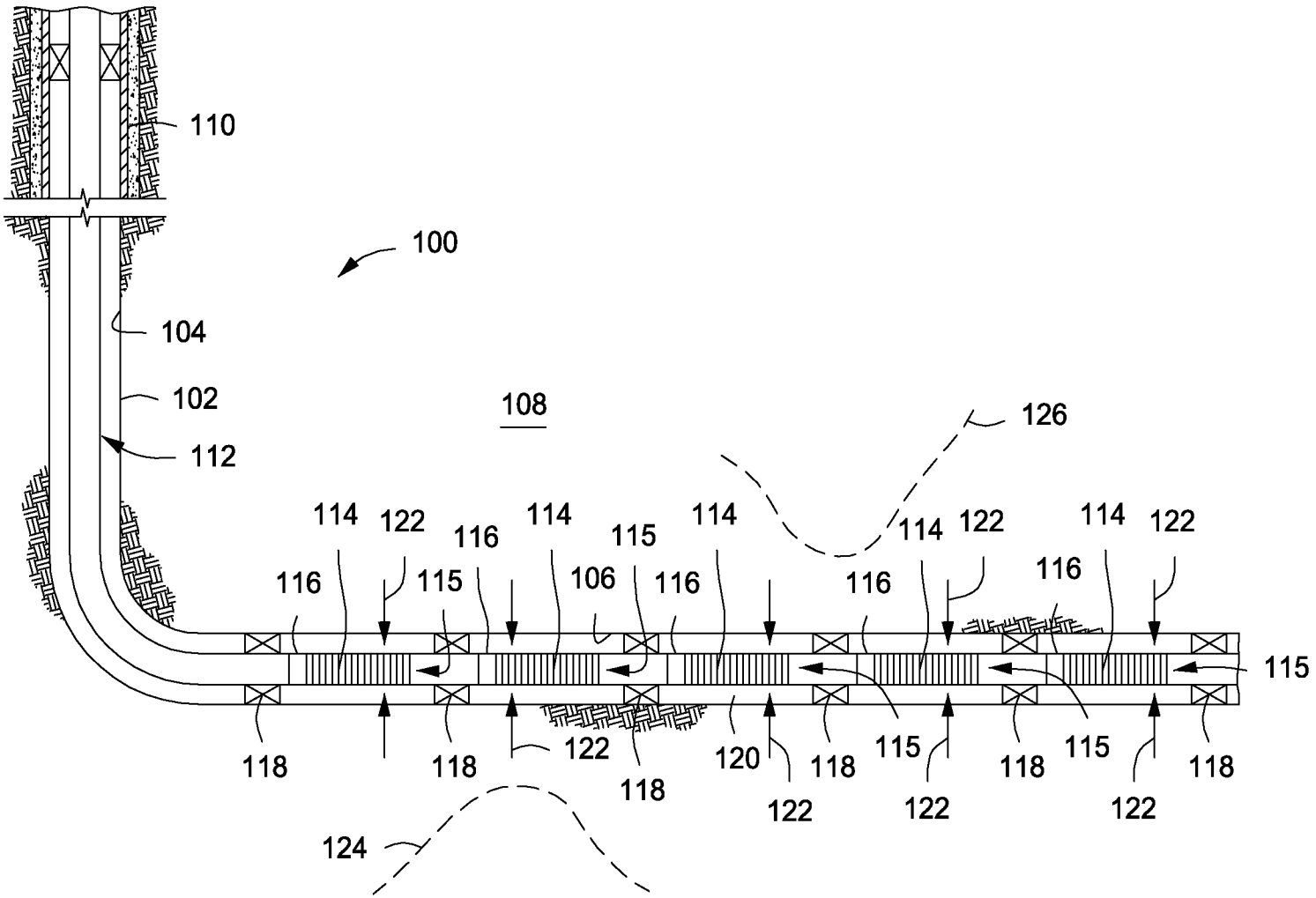
FIG. 1 illustrates a well system that can exemplify the principles of the present disclosure, according to one or more embodiments described herein.

Referring to FIG. 1, illustrated is a well system 100 that exemplifies principles of the present disclosure, according to one or more embodiments. As illustrated, well system 100 may include a wellbore 102 that has a generally vertical uncased section 104 that transitions into a generally horizontal uncased section 106 extending through a subterranean earth formation 108. In some embodiments, the vertical uncased section 104 may extend downwardly from a portion of the wellbore 102 having a casing string 110 cemented therein. An elongate tubular base pipe, such as production tubing 112, may be installed or otherwise extended into the wellbore 102.

One or more flow distribution assemblies 115 may be arranged about the production tubing 112. As illustrated, each flow distribution assembly 115 (herein after "assembly 115") may include one or more well screens 114 arranged about the production tubing 112 and one or more flow control devices 116. In some embodiments, one or more packers 118 or other wellbore isolation devices may be disposed about the production tubing 112, and configured to seal off an annulus 120 defined between the production tubing 112 and the walls of the wellbore 102. As a result, fluids 122 may be produced from multiple intervals or "pay zones" of the surrounding subterranean formation 108 via isolated portions of the annulus 120 between adjacent pairs of the packers 118. The fluid 122 may be a fluid composition originating from the surrounding formation 108 and may include one or more fluid components, such as oil and water, oil and gas, gas and water, gas and oil, oil, water, and gas, and the like.

The well screens 114 and flow control devices 116 may be in fluid communication with each other and the interior of the production tubing 112 through one or more flow ports (not shown) defined in the production tubing 112. The well screens 114 may be any type of screen known to those skilled in the art including, but not limited to, wire wrap screens, swell screens, sintered metal mesh screens, expandable screens, pre-packed screens, or treating screens. In some embodiments, the well screens 114 may additionally include a drainage layer and/or an outer protective shroud extending along an exterior portion thereof. In some embodiments, the well screens 114 may have a mesh layer disposed about the outer perimeter of the well screens 114. In operation, the well screen 114 may be configured to filter the fluids 122 flowing into the production tubing 112 from the subterranean formation 108 and through annulus 120. The flow control device 116 may be configured to restrict or otherwise regulate the flow of the fluids 122 into the production tubing 112.

Those skilled in the art will readily recognize the advantages of being able to regulate the flow of fluids 122 into the production tubing 112 from each zone of the subterranean formation 108, for example, to prevent water coning 124 or gas coning 126 in the subterranean formation 108. Other uses for flow regulation in a well may include, but are not limited to, balancing production from (or injection into) multiple zones, minimizing production (or injection) of undesired fluids, maximizing production (or injection) of desired fluids, and the like. The present disclosure may specifically be advantageous in steam injection as well as steam assisted production operations. The flow control devices 116 may provide such benefits by increasing resistance to flow if a fluid velocity increases beyond a selected level (e.g., to thereby balance flow among zones, prevent water coning 124 or gas coning 126, etc.), increasing resistance to flow if a fluid viscosity or density decreases below a selected level (e.g., to thereby restrict flow of an undesired fluid, such as water or gas, in an oil producing well), and/or increasing resistance to flow if a fluid viscosity or density increases above a selected level (e.g., to thereby minimize injection of water in a steam injection well).

It will be appreciated by one of skill in the art that the well system 100 of FIG. 1 is merely one example of a wide variety of well systems in which the principles of the present disclosure may be utilized. Accordingly, the principles of this disclosure are not necessarily limited to any of the details of the depicted well system 100, or the various components thereof, depicted in the drawings or otherwise described herein. For example, it is not necessary in keeping with the principles of this disclosure for the wellbore 102 to include a generally vertical uncased section 104 or a generally horizontal uncased section 106.

Furthermore, it is not necessary that at least one well screen 114 and flow control device 116 be positioned between a pair of packers 118. Nor is it necessary for a single flow control device 116 to be used in conjunction with a single well screen 114. Rather, any number, arrangement, and/or combination of such components may be used, without departing from the scope of the present disclosure. In addition, it is not necessary for the well screens 114, flow control devices 116, packers 118, or any other components of the production tubing 112 to be positioned in vertical uncased section 104 or horizontal uncased section 106 of the wellbore 102. Rather, any section of the wellbore 102 may be cased or uncased, and any portion of the assemblies 115 may be positioned in an uncased or cased section of the wellbore 102, without departing from the scope of the disclosure.

Figure 2:
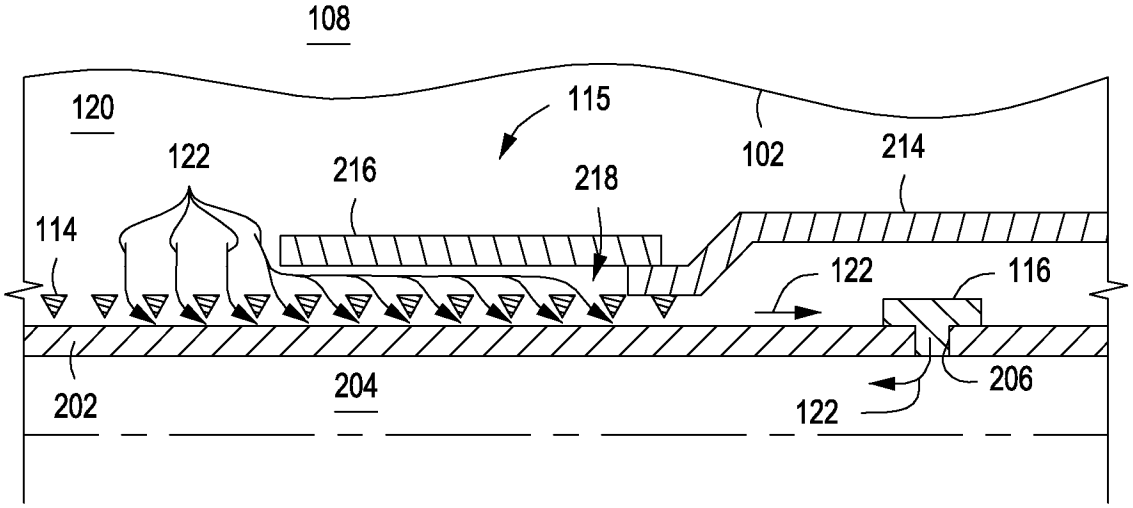
FIG. 2 illustrates an enlarged cross-sectional view of an exemplary flow distribution assembly, according to one or more embodiments described herein.

Referring now to FIG. 2, with continued reference to FIG. 1, illustrated is an enlarged cross-sectional view of an exemplary flow distribution assembly 115, according to one or more embodiments. As illustrated, the flow distribution assembly 115 (hereinafter "assembly 115") may include at least one well screen 114 arranged about a base pipe 202 having an interior 204. At least a portion of the well screen 114 may be operably coupled or otherwise generally arranged about the outer circumference of the base pipe 202, and the base pipe 202 may be or otherwise form a portion of the production tubing 112 of FIG. 1. The base pipe 202 may include one or more openings or flow ports 206 that place the interior 204 of the base pipe 202 in fluid communication with the annulus 120 formed between the outer diameter of assembly 115 and the wellbore 102.

As depicted, the assembly 115 may further include a housing 214 arranged at or near an end of the well screen 114. In some embodiments, the well screen 114 may be coupled to the housing 214, such as through welding, brazing, mechanical fasteners, adhesives, or combinations thereof. The housing 214 may be configured to extend about the base pipe 202 and generally encompass the axial locations of the flow ports 206.

The flow control device 116 may be arranged at or near the flow ports 206. In the depicted embodiment, the flow control device 116 is arranged within the flow port 206. In other embodiments, however, the flow control device 116 may be arranged at any point between the well screen 114 and the flow ports 206. For instance, in at least one embodiment, the flow control device 116 may be coupled to or otherwise form an integral part of the housing 214. In yet other embodiments, there may be multiple flow control devices 116 configured to facilitate fluid communication between the annulus 120 and the flow port(s) 206.

The flow control device 116 may be any type of flow control device known to those skilled in the art (e.g., an orifice, a nozzle, an ICD, an AICD, etc.). The flow port 206 may itself be defined as a flow control device. In operation, the flow control device 116 may be generally configured to regulate the influx of fluids 122 into the interior 204 of the base pipe 202. It should be noted that the flow control device 116 is shown and described merely for illustrative purposes and therefore should not be considered as limiting the present disclosure to the depicted design or configuration.

For example, the flow control device 116 may be radially or axially mounted at or near flow port 206.

The assembly 115 may further include a shroud 216 arranged about at least a portion of the well screen 114 adjacent the flow control device 116. In the illustrated embodiment, the shroud 216 is arranged such that an annular gap 218 is formed between the outer diameter of the well screen 114 and the inner diameter of the shroud 216. The shroud 216 may be coupled to the housing 214 and extend axially therefrom. As will be discussed below, however, in other embodiments the shroud 216 may be arranged about any portion of the well screen 114 so as to form the annular gap 218, without departing from the scope of this disclosure.

In exemplary operation of the assembly 115, fluid 122 from the annulus 120 may be drawn through the well screen 114 and thereby filtered before flowing through the flow control device 116 and the flow port 206 into the interior 204 of base pipe 202. Since the fluid 122 will naturally follow the path of least resistance, it tends to be drawn into the well screen 114 closest to the flow control device 116. The shroud 216, however, may prove useful in increasing the flow resistance of the incoming fluid 122 closest to the flow control device 116 by channeling the fluid 122 into the annular gap 218. As a result, the flow energy of the fluid 122 closest to the flow control device 116 may be distributed over the axial length of the well screen 114 encompassed by the shroud 216. That is, the shroud 216 may help match the flow area of the annular gap 218 with the flow area of the well screen 114 in order to more evenly distribute the flow of the fluid 122.

By distributing the flow energy of the fluid 122 over a greater axial length of the well screen 114, the well screen 114 may be less susceptible to erosion or damage attributable to high velocity influx of the fluid 122 at or near the end of the well screen 114 and adjacent the flow control device 116. The fluid 122 may then be drawn into the flow control device 116 and eventually enter the interior 204 of base pipe 202 through the flow port(s) 206.

In some embodiments, a mesh (not shown) may be arranged within the annular gap 218. The mesh may increase the flow resistance over the axial length of the well screen 114 encompassed by the shroud 216 and may therefore aid in distributing the flow energy along the well screen 114. The mesh may be any semi-permeable barrier made of connected strands of a metal, a plastic, fiberglass, or an otherwise flexible and ductile material. The flow resistance created as a result of including mesh in the annular gap 218 may be controlled by any means known to those of skill in the art, including, for example, varying the mesh size (e.g., depth), varying the number of layers of mesh, varying the density of the mesh, and the like.

The shroud 216 may be formed from any rigid, and preferably non-brittle, material suitable for use in a subterranean formation operation. Such suitable materials may include, but are not limited to, a plastic (e.g., a polyethylene terephthalate, a thermoset plastic, a resin, polystyrene, polyvinyl chloride, polypropylene, high-density polyethylene, phenolic, and the like), a fiber reinforced plastic, a metal (e.g., aluminum, zinc, iron, and the like), a metal alloy (e.g., steel, iconel, hastelloy, brass, and the like), a ceramic (e.g., an oxide ceramic, a carbide ceramic, a boride ceramic, a nitride ceramic, a silicate ceramic, and/or a ceramic composite material), a metal carbide (e.g., tungsten carbide, silicon carbide, titanium carbide, and the like), alumina, titania, zirconia, a rigid non-metal material, and any combination thereof, provided that the material is capable of withstanding the conditions of the formation in which it is to be used (e.g., temperature, pressure, and the like). The metal alloy may additionally be a precipitation-hardening alloy, such as duralumin. In some embodiments, the plastics may have embedded therein a filler material, such as glass particulates or fibers, to increase the durability and rigidity of the plastic.

Figure 3:
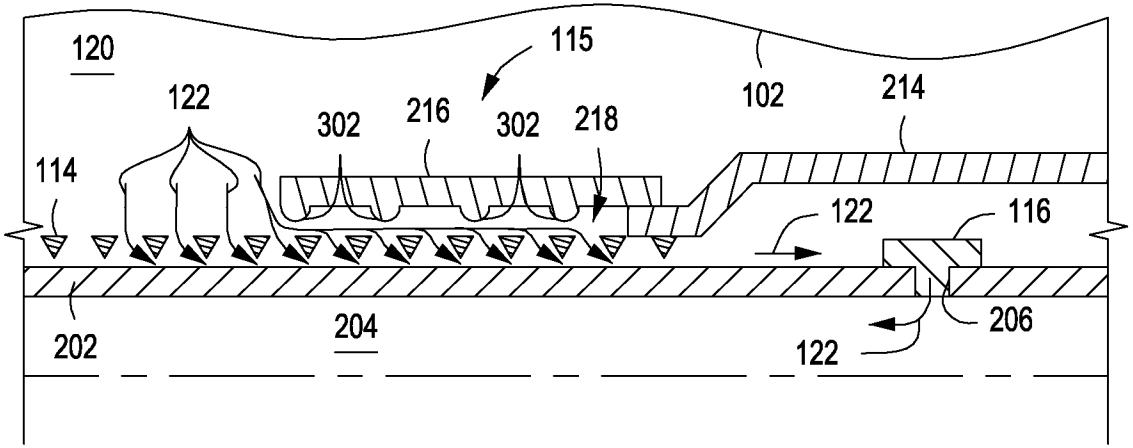
FIG. 3 illustrates an enlarged cross-sectional view of an exemplary flow distribution assembly, according to one or more embodiments described herein.

Referring now to FIG. 3, illustrated is another enlarged cross-sectional view of one of the assemblies 115 of FIG. 1, according to one or more embodiments of the present disclosure. The assembly 115 depicted in FIG. 3 may be substantially similar to the assembly 115 of FIG. 2 and, therefore, may be best understood with reference thereto, where like numerals refer to like elements not described again in detail.

As illustrated, the shroud 216 may have one or more dimples 302 protruding radially into the annular gap 218 and toward the outer diameter of the well screen 114. In some embodiments, the dimples 302 may be an integral part or portion of the shroud 216 and manufactured therewith. In other embodiments, the dimples 302 may be formed on the inner surface of the shroud 216 by plastically deforming the shroud 216, such as through crimping. Moreover, in some embodiments, one or more of the dimples 302 may be annular protrusions that extend about the entire inner surface of the shroud 216. In other embodiments, however, one or more of the dimples 302 may be point protrusions located at various locations on the inner surface of the shroud 216. While four dimples 302 are depicted in FIG. 3, those skilled in the art will readily appreciate that any number of dimples 302 may be defined on the shroud 216, without departing from the scope of this disclosure.

As will be appreciated by one of skill in the art, the dimples 302 may be equidistantly spaced, as shown, or may be spaced apart randomly or arranged in any other configuration, without departing from the scope of this disclosure. For example, in one embodiment, one or more dimples 302 may be located distal to the housing 214 and one or more dimples 302 may be located proximal to the housing 214 such that a dimple-free area is located therebetween. In other embodiments, one or more dimples 302 may be located only on the portion of the shroud 216 distal to the housing 214, or, alternatively, only on the portion of the shroud 216 proximal to the housing 214. In yet other embodiments, the frequency of the dimples 302 may progressively increase along the axial length of the shroud 216 in the direction toward the housing 214. Such a configuration may result in progressively restricting the flow of the fluid 122 as it nears the flow control device 116.

The distance between the well screen 114 and the dimples 302 may be any distance suitable for increasing the resistance to the flow of the fluid 122 as it flows toward the flow control device 116. In general, the smaller the distance between the dimples 302 and the outer diameter of the well screen 114, the greater the resistance to the flow of the fluid 122. One of skill in the art, with the benefit of this disclosure, will appreciate what distance is suitable for a particular subterranean operation based on a number of factors including, but not limited to, the conditions of the fluid 122 (e.g., viscosity), the gauge of the well screen 114, the size of the flow channel between the outer diameter of the base pipe 202 and the inner diameter of the well screen 114, and the like.

As depicted, the shape of the dimples 302 may be substantially arcuate or round. However, the dimples 302 may be any other shape, without departing from the scope of this disclosure. For example, in some embodiments, the dimples 302 may be cubic-shaped, polygonal-shaped, or any other shape capable of increasing the resistance to the flow of fluid 122 as it flows toward the flow control device 116. Moreover, the size of the dimples 302 may by any size suitable for increasing the flow resistance to the fluid 122. In some embodiments, the dimples 302 defined on the shroud 216 may each be the same size. In other embodiments, however, the sizes of the dimples 302 may vary. For example, in some embodiments, the dimples 302 may progressively increase in size in the direction toward the housing 214. Such a configuration may provide for progressive fluid restriction as the fluid 122 nears the flow control device 116 by increasing resistance to the fluid 122 as it is flowing thereto.

Like the embodiment shown in FIG. 2, a mesh (not shown) may also be arranged within the annular gap 218. The mesh may further increase the flow resistance and otherwise aid in distributing the flow energy over the axial length of the well screen 114 radially adjacent the shroud 216 including dimples 302.

Figure 4:
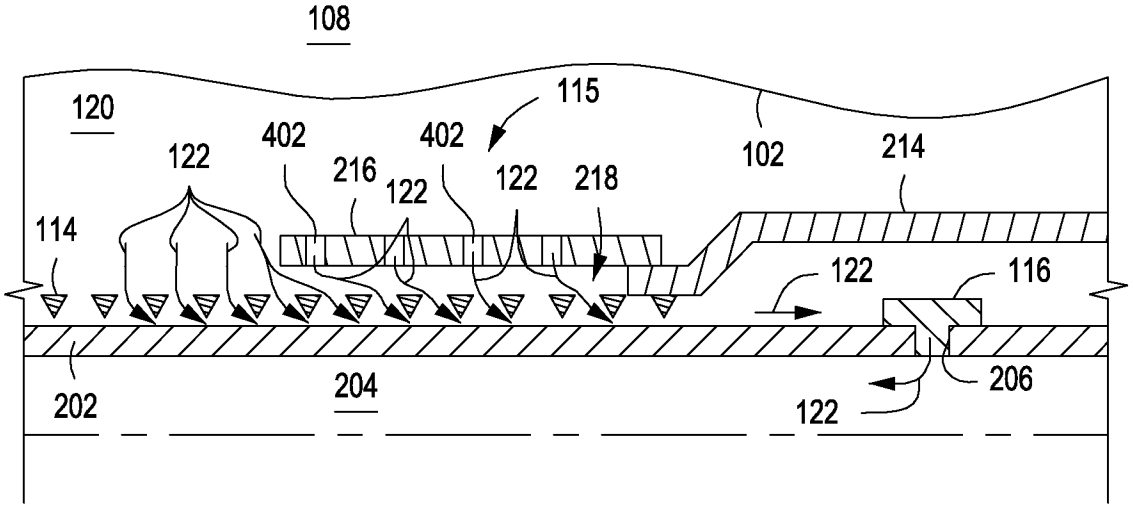
FIG. 4 illustrates an enlarged cross-sectional view of an exemplary flow distribution assembly, according to one or more embodiments described herein.

Referring now to FIG. 4, illustrated is another enlarged cross-sectional view of one of the assemblies 115 of FIG. 1, according to one or more embodiments. The assembly 115 depicted in FIG. 4 may be substantially similar to the assembly 115 of FIG. 2 and, therefore, may be best understood with reference thereto, where like numerals refer to like elements not described again in detail.

As illustrated, the shroud 216 may have one or more perforations 402 defined therein and configured to allow fluids 122 to flow from the annulus 120, through the shroud 216, and into the annular gap 218. The perforations 402 may be configured to distribute the flow energy of the fluids 122 prior to passing through the well screen 114, and thereby serve to protect the well screen 114 from erosion or deformation. While four perforations 402 are depicted in FIG. 4, those skilled in the art will readily appreciate that any number of perforations 402 may be included within the shroud 216, without departing from the scope of this disclosure.

The perforations 402 may be defined in the shroud 216 as equidistantly spaced from each other. In other embodiments, the perforations 402 may be randomly defined in the shroud 216, without departing from the scope of this disclosure. For example, in one embodiment, one or more perforations 402 may be located distal to the housing 214 and one or more perforations 402 may be located proximal to the housing 214 such that a perforation-free area is located therebetween. In other embodiments, one or more perforations 402 may be located only on the portion of the shroud 216 distal to the housing 214, or, alternatively, only on the portion of the shroud 216 proximal to the housing 214. In yet other embodiments, the frequency or density of the perforations 402 may progressively increase along the length of the shroud 216 away from housing 214. Such a configuration may provide for progressive fluid restriction as the fluid 122 nears the flow control device 116 by increasing resistance to the fluid 122 as it is flowing thereto.

The size of the perforations 402 defined in the shroud 216 may by any size suitable for increasing the flow resistance to the fluid 122. In some embodiments, all the perforations 402 may exhibit the same size. In other embodiments, however, the perforations 402 may exhibit differing sizes. For example, in some embodiments, the perforations 402 may progressively increase in size moving away from the housing 214 (or progressively decrease in size toward the housing 214). Such a configuration may prove advantageous in progressively restricting the flow of the fluid 122 closer to the flow control device 116, and thereby distributing the flow energy of the fluid 122 closest to the flow control device 116 over the axial length of the well screen 114 encompassed by the shroud 216.

As with prior embodiments, although not shown, a mesh may be arranged or otherwise disposed within the annular gap 218. The mesh may further increase the fluid resistance and therefore aid in distributing the flow energy over the axial length of the well screen 114. Additionally, the shroud 216 may also be configured with one or more of the dimples 302 described above with reference to FIG. 3. As will be appreciated, the dimples 302 may be arranged or otherwise defined in any configuration (i.e., any size, shape, frequency or density) described herein. That is, the shroud 216 may include one or more perforations 402 in any described configuration, but may also include perforations 402 and dimples 302, perforations 402 and mesh arranged in the annular gap 218, or a combination of perforations 402, dimples 302, and mesh, without departing from the scope of the disclosure.

Figure 5:
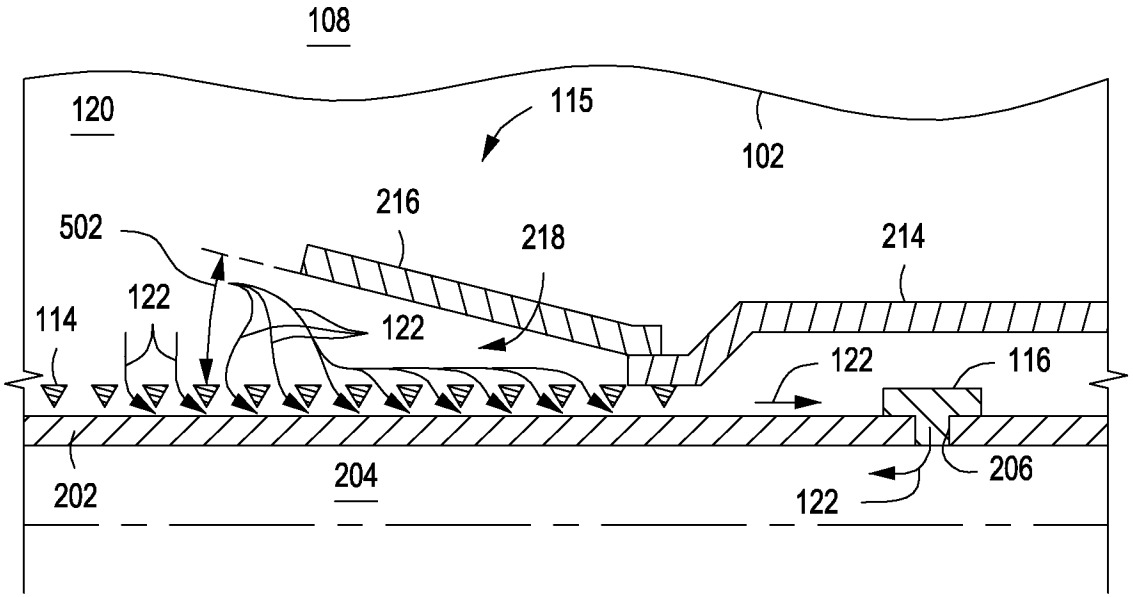
FIG. 5 illustrates an enlarged cross-sectional view of an exemplary flow distribution assembly, according to one or more embodiments described herein.

Referring now to FIG. 5, illustrated is another enlarged cross-sectional view of one of the assemblies 115 of FIG. 1, according to one or more embodiments of the present disclosure. The assembly 115 depicted in FIG. 5 may be substantially similar to the assembly 115 of FIG. 2 and, therefore, may be best understood with reference thereto, where like numerals refer to like elements not described again in detail.

As illustrated, the shroud 216 may be cone-shaped or otherwise progressively tapered in a direction toward the housing 214 or the flow control device 116. Thus, the size of the annular gap 218 may progressively decrease toward the flow control device 115. Such a configuration may progressively restrict the flow of the fluid 122 closest to the flow control device 116, and thereby more evenly distribute the flow energy of the fluid 122 over the axial length of the well screen 114 encompassed by the shroud 216.

In some embodiments, the shroud 216 may be tapered at a predetermined angle 502 between the inner surface of the shroud 216 and the outer diameter of the well screen 114. As depicted in FIG. 5, the angle 502 is exaggerated for illustrative purposes, and therefore should not be considered as limiting the present disclosure. As will be appreciated, the angle 502 may have any value suitable for progressively increasing the flow resistance to the fluid 122 as it is drawn into the well screen 114 and progresses toward the flow control device 116. In exemplary embodiments, the angle 502 may be a relatively acute or shallow angle, such as in the range of between about 0.5° to about 10°, and encompassing any angle value therebetween.

In some embodiments, the taper of the shroud 216 may not be continuous, but rather stepped. More particularly, the shroud 216 may have two or more portions that exhibit different inner diameters along the axial length of the shroud 216. The portions of the shroud 216 may be angled or may be substantially parallel with the outer surface of the well screen 114. In any configuration, however, the volume of the annular gap 218 may be smaller at or near the flow control device 116 than at the distal end of the shroud 216, and thereby serve to progressively restrict the flow of the fluid 122 closest to the flow control device 116.

As with prior embodiments, although not shown, a mesh may be arranged within the annular gap 218 created between the tapered shroud 216 and the outer diameter of the well screen 114. Additionally, the shroud 216 may also be configured to have one or more dimples 302 (FIG. 3) protruding into the annular gap 218, in any configuration (i.e., any size, shape, frequency or density) as described herein, or one or more perforations 402 (FIG. 4) defined in the shroud 216, in any configuration (i.e., any size, or shape, frequency or density), as described herein. That is, the tapered shroud 216 may include one or more perforations in any configuration; may include one or more dimples in any configuration; may include mesh arranged in the annular gap 218; may include one or more perforations in any configuration and one or more dimples in any configuration; may include one or more perforations in any configuration, one or more dimples in any configuration, and mesh arranged in the annular gap 218; may include one or more dimples in any configuration and mesh arranged in the annular gap 218; or may include one or more perforations and mesh arranged in the annular gap 218.

Figure 6:
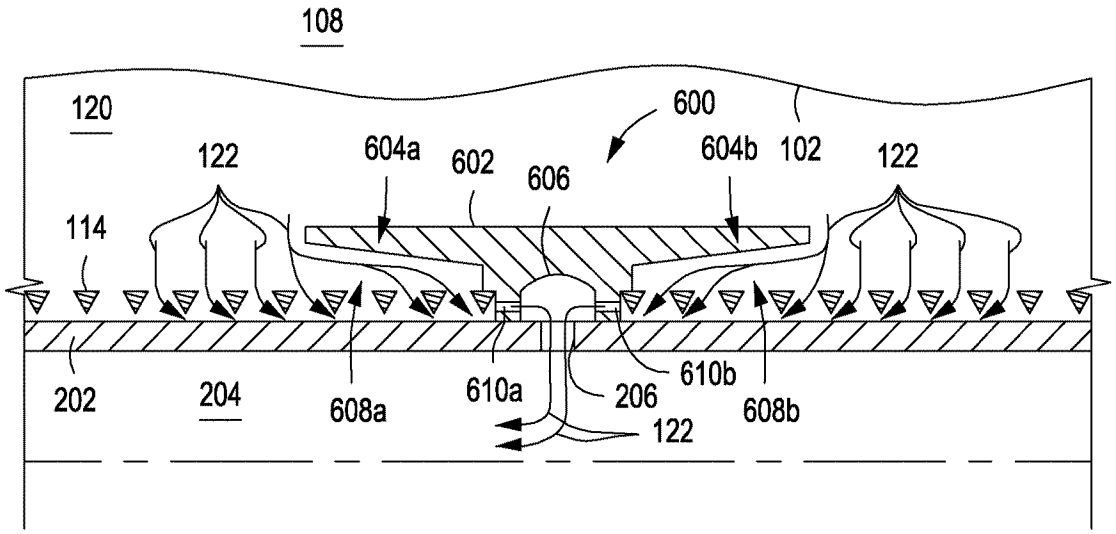
FIG. 6 illustrates an enlarged cross-sectional view of an exemplary flow distribution assembly, according to one or more embodiments described herein.

Referring now to FIG. 6, with continued reference to FIG. 1 and FIG. 2, illustrated is an enlarged cross-sectional view of an exemplary flow distribution assembly 600 (hereinafter "assembly 600"), according to one or more embodiments disclosed herein. Portions of the assembly 600 may be substantially similar to the assemblies 115 of FIGS. 2-5 and, therefore, may be best understood with reference thereto, where like numerals refer to like elements not described again in detail.

FIG. 6 generally shows a method that may be used for manufacturing or otherwise building the assembly 600, according to one or more embodiments herein. As depicted, the well screen 114 may be operably coupled or otherwise generally arranged about the outer circumference of the base pipe 202. As depicted, at least a portion of the well screen 114 may be removed at or near the flow port(s) 206. The assembly 600 may include a shroud 602 capable of receiving fluids 122 on either end of the shroud 602 simultaneously. The shroud 602 may be installed and otherwise arranged about the base pipe 202 where the well screen 114 is removed. In some embodiments, the well screen 114 on either axial end of the shroud 602 may be coupled to the shroud 602.

The shroud 602 may be arranged about the base pipe 202 such that an uphole annular gap 608*a* and a downhole annular gap 608*b* is formed between the shroud 602 and the outer diameter of the well screen 114. As illustrated, the shroud 602 may have or otherwise define an uphole extension 604*a* and a downhole extension 604*b*. In some embodiments, an arch 606 may extend between the uphole and downhole extensions 604*a,b*. One or both of the uphole and downhole extensions 604*a,b* may be coupled to the base pipe 202 where the portion of the well screen 114 has been removed so as to axially span the flow port 206. That is, the flow port 206 may interpose the uphole and downhole extensions 604*a,b*.

The flow port(s) 206 may be in fluid communication with portions of the well screen 114 on either axial end of the shroud 602 via flow orifices 610 (shown as flow orifices 610*a* and 610*b*) defined through or otherwise provided in the shroud 602. The flow orifices 610*a,b* may serve as flow restrictors for the flow of the fluid 122 toward the flow port(s) 206. Accordingly, the flow orifices 610*a,b* may be characterized as flow control devices, such as any of those described herein (e.g., ICD, AICD, and the like). In other embodiments, a flow control device may be arranged within one or both of the flow orifices 610*a,b*, without departing from the scope of this disclosure.

It should be noted that the assembly 600 is shown and described merely for illustrative purposes and therefore should not be considered as limiting the present disclosure to a particular design or configuration. For example, the assembly 600 may include one or more shrouds 602 at one or more distinct locations along the axial length of the well screen 114. Additionally, the base pipe 202 may have more than one flow port 206 defined therein and in fluid communication with the flow orifices 610*a*, without departing from the scope of the present disclosure.

In exemplary operation of the assembly 600, fluid 122 from the annulus 120 may be drawn through the well screen 114 and thereby filtered before flowing through the flow orifices 610*a,b* and into the interior 204 of the base pipe 202 through the flow port 206. The shroud 602 may serve to distribute the flow energy of the fluid 122 along the axial length of the well screen 114 on opposing sides of the shroud 602. As illustrated, the uphole and downhole extensions 604*a,b* may be tapered or frustoconical, similar to the shroud 216 of FIG. 5. As a result, the volume of the uphole annular gap 608*a* may progressively decrease in the direction toward the first flow orifice 610*a*, and the volume of the downhole annular gap 608*b* may progressively decrease in the direction toward the second flow orifice 610*b*.

As with the shroud 216 of FIG. 5, the uphole and downhole extensions 604*a,b* of the shroud 602 may be tapered at any angular value suitable for increasing the flow resistance to the fluid 122 as it is drawn into the well screen 114 and progresses toward the flow conduits 610*a,b*. Although the angle of the uphole and downhole extensions 604*a,b* are depicted as being generally identical, they may be different from one another, without departing from the scope of the present disclosure. In other embodiments, however, one or both of the uphole and downhole extensions 604*a,b* of the shroud 602 may be stepped, as generally described above. Such a tapered or stepped configuration may provide for progressive fluid restriction as the fluid 122 nears the flow conduits 610*a,b* by increasing fluid resistance as it is flowing thereto.

It will be appreciated that the shroud 602 may be of any shape, provided that it is capable of providing increased resistance to the flow of fluid 122 through the well screen 114, without departing from the scope of the present disclosure. Moreover, the shroud 602 need not be tapered or stepped, but may be configured such that the diameter of the annular gaps 608*a* and/or 608*b* are of a constant diameter, similar to the annular gap 218 of FIG. 2 (i.e., the distance between the shroud 602 and the outer diameter of the well screen 114 does not vary). In other embodiments, the portions of the uphole and downhole extensions 604*a,b* may include one or more dimples 302 (FIG. 3), one or more perforations 402 (FIG. 4), and/or may have mesh material arranged or otherwise disposed within one or both of the annular gaps 608*a,b*, without departing from the scope of the present disclosure.

Figure 7:
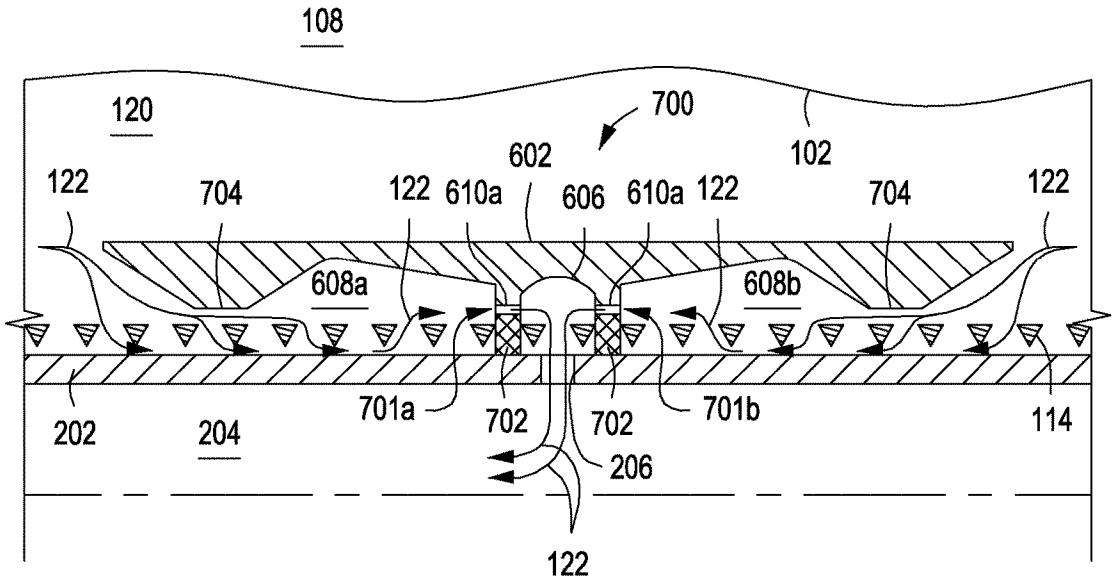
FIG. 7 illustrates an enlarged cross-sectional view of an exemplary flow distribution assembly, according to one or more embodiments described herein.

Referring now to FIG. 7, illustrated is an enlarged cross-sectional view of another exemplary flow distribution assembly 700, according to one or more embodiments described herein. The assembly 700 depicted in FIG. 7 may be substantially similar to the assembly 600 of FIG. 6 and, therefore, may be best understood with reference thereto, where like numerals refer to like elements not described again in detail.

FIG. 7 generally shows an alternative method that may be used for manufacturing or otherwise building the assembly 700, according to one or more embodiments herein. As illustrated, the shroud 602 may be arranged about the well screen 114 and coupled thereto by an upper support 701*a* and a lower support 701*b* extending radially inward from the shroud 602. As illustrated, the flow orifices 610*a,b* may be defined in the upper and lower supports 701*a,b*, respectively. The shroud 602 may be coupled to the screen 114 at one or both of the upper and lower supports 701*a,b* in a variety of ways including, but not limited to, crimping the shroud 602 to the well screen 114, welding or brazing the shroud 602 to the well screen 114, or using an industrial adhesive.

In some embodiments, the shroud 602 may be coupled to the well screen 114 by crimping or tack welding the supports 701*a,b* thereto. Prior to attaching the shroud 602 to the well screen 114, a sealing or plugging material 702 may be deposited and otherwise arranged on the well screen 114 on either side of the flow port(s) 206. In other embodiments, the plugging material 702 may be deposited on either side of the flow port(s) 206 following installation of the shroud 602 by being pumped through the well screen 114 beneath the supports 701*a,b*. As illustrated, the plugging material 702 may be deposited such that it directly contacts the base pipe 202 and extends radially at least partially through the well screen 114.

The plugging material 702 may be configured to form a fluid barrier between the well screen 114 and the base pipe 202 at the particular location. In other words, the plugging material 702 permits fluids 122 to be drawn through the well screen 114 and through the flow orifices 610*a,b* prior to flowing into the interior 204 of the base pipe 202 through the flow port 206. The plugging material 702 may be any material capable of forming a fluid barrier to force the fluid 122 through the flow orifices 610*a,b* prior to flowing into the interior 204 of the base pipe 202 through flow port(s) 206. Suitable plugging materials may include, but are not limited to a resin, a low-melt metal, a rubber, and any combination thereof.

Suitable resins for use as the plugging material 702 may include, but are not limited to, two component epoxy based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, silicon-based resins, polyester resins, polyester resin hybrids, polyester resin copolymers, polyurethane resins, polyurethane resin hybrids, polyurethane resin copolymers, acrylate resins, and any combination thereof. Suitable low-melt metals may include, but are not limited to, mercury-containing alloys, lithium-containing alloys, sodium-containing alloys, potassium-containing alloys, rubidium-containing alloys, caesium-containing alloys, francium-containing alloys, gallium-containing alloys, bismuth-containing alloys, lead-containing alloys, tin-containing alloys, cadmium-containing alloys, zinc-containing alloys, indium containing alloys, thallium-containing alloys, and any combination thereof. The rubber for use as the plugging material 702 may be a natural rubber, a modified rubber, a synthetic rubber, and any combination thereof. Suitable rubbers may include, but are not limited to, a cis-1,4-polyisoprene rubber; a trans-1,4-polyisoprene rubber; a synthetic polyisoprene rubber; a polybutadiene rubber; a chloroprene rubber; a polychloroprene rubber; an isobutylene/isoprene copolymer; styrene-butadiene rubber; a halogenated butyl rubber (e.g., chloro butyl rubber, bromo butyl rubber); a butadiene/acrylonitrile copolymer; an ethylene-propylene rubber; a nitrile-butadiene rubber; a polyisoprene rubber; a butadiene-isoprene rubber; any derivatives thereof and any combination thereof.

As shown, the shroud 602 may further include one or more dimples 704, similar to the dimples 302 of FIG. 3, located uphole and/or downhole from the flow port(s) 206. As with the dimples 302, the dimples 704 depicted in FIG. 7 may facilitate increased fluid resistance as the fluid 122 nears the flow orifices 610*a,b*, and thereby distributes the flow energy of the fluid 122 across a greater portion of the well screen 114. It will be appreciated that in other embodiments the shroud 602 need not include the dimples 704 or have tapered annular gaps 608*a,b*. In some embodiments, the shroud 602 may include or otherwise define one or more of the perforations 402 described with reference to FIG. 4, and/or mesh material arranged within one or both of the annular gaps 608*a,b*, or any combination of the embodiments disclosed herein.

Figure 8:
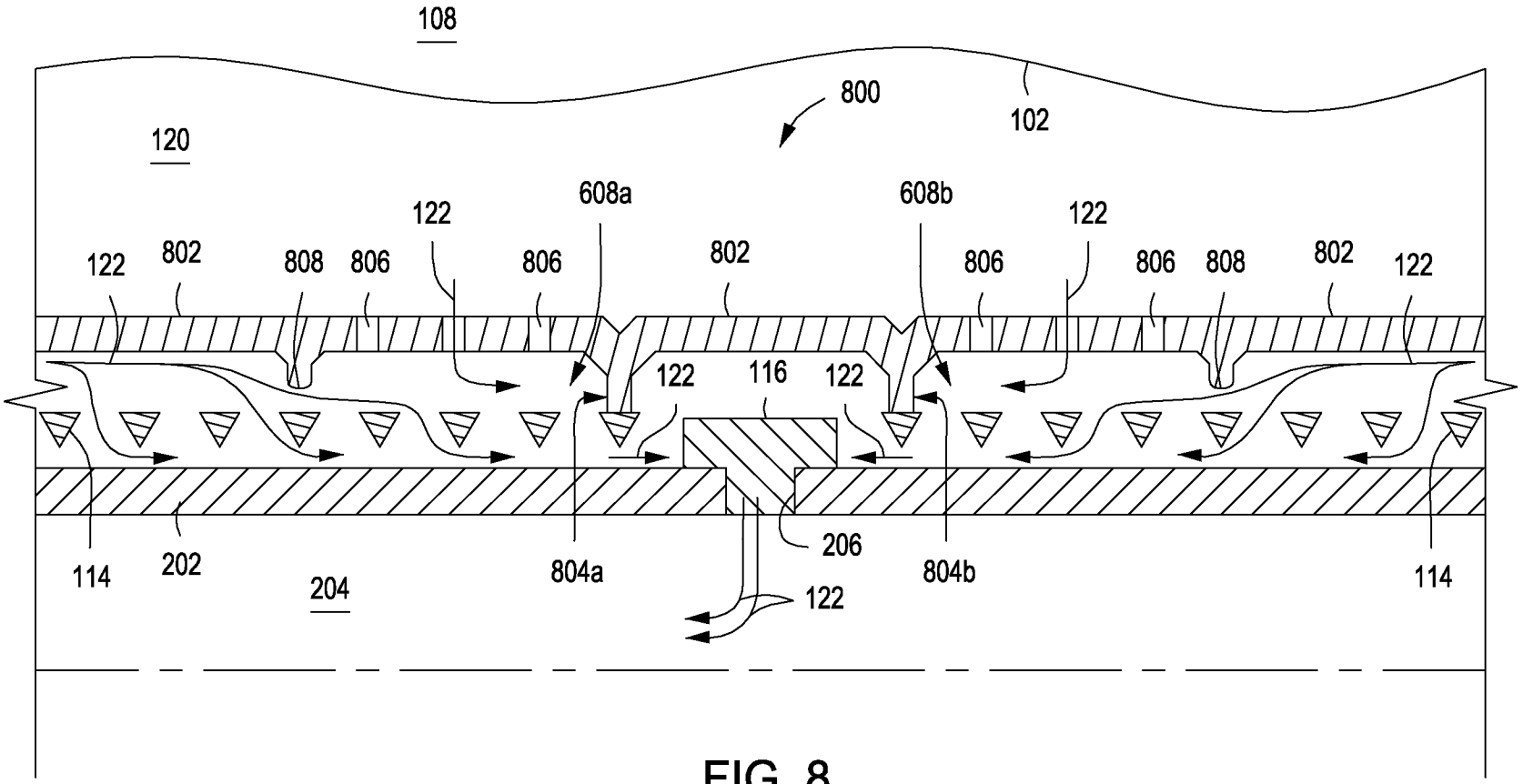
FIG. 8 illustrates an enlarged cross-sectional view of an exemplary flow distribution assembly, according to one or more embodiments described herein.

Referring now to FIG. 8, illustrated is an enlarged cross-sectional view of view of another exemplary flow distribution assembly 800, according to one or more embodiments described herein. The assembly 800 depicted in FIG. 8 may be substantially similar to the assembly 600 of FIG. 6 and, therefore, may be best understood with reference thereto, where like numerals refer to like elements not described again in detail.

As illustrated, the shroud 802 may be arranged about the well screen 114 and coupled thereto at one or more supports 804 (shown as an upper support 804*a* and a lower support 804*b*). In some embodiments, the shroud 802 may be coupled to the well screen 114 by crimping or tack welding the supports 804*a,b* thereto. In other embodiments, the shroud 802 may be crimped to the well screen 114, brazed to the well screen 114, or attached thereto using an industrial adhesive or the like. Although not depicted, the supports 804*a*, 804*b* may include flow control devices arranged therein, without departing from the scope of the present disclosure.

In some embodiments the portion of the well screen 114 may be removed between the supports 804*a,b*, and one or more flow ports 206 may be arranged axially therebetween. A flow control device 116 may be arranged at or near the flow port(s) 206. Although depicted as having a portion of the well screen 114 removed, it will be appreciated that the well screen 114 may remain intact, without departing from the scope of the present disclosure. As illustrated, the shroud 802 may have one or more perforations 806 and one or more dimples 808 arranged uphole and/or downhole from the flow port(s) 206.

In exemplary operation, fluids 122 from the annulus 120 may be drawn into the well screen 114 at an end of the shroud 802 or through the one or more perforations 806 and thereby be filtered before flowing through the flow control device 116 and the flow port 206 into the interior 204 of the base pipe 202. The perforations 806 and the dimples 808 may generally provide for progressive fluid restriction as the fluid 122 nears the flow control device 116 by increasing resistance to the fluid 122 as it is flowing thereto. Although the shroud 802 is depicted as having a particular number of perforations 806 and dimples 808, any number of perforations 806 and/or dimples 808, including no perforations 806 and/or no dimples 808, may be provided without departing from the scope of the present disclosure. Moreover, portions of the shroud 802 may be tapered as described with reference to FIG. 6, may include mesh material arranged within annular gaps 608*a*, 608*b*, or any combination thereof. That is, the shroud 802 may include, in any combination, perforations 806, dimples 808, tapered annular gaps 608*a*, 608*b*, and/or mesh arranged within the annular gaps 608*a*, 608*b*, without departing from the scope of the present disclosure.

While the embodiments depicted herein illustrate the advantages obtained by distributing flow energy across portions of well screens during production operations, those skilled in the art will readily appreciate that the described embodiments may equally prove advantageous for injection operations. More particularly, the various embodiments and configurations of the shroud and its attendant components described herein may equally be configured to distribute flow energy across portions of well screens for fluids being injected from the production tubing and into the surrounding formations. Accordingly, while not specifically depicted herein, it is further contemplated herein that the flow of the fluid 122 in each figure included herein may be reversed, without departing from the scope of the disclosure.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

One or more illustrative embodiments disclosed herein are presented below. Not all features of an actual implementation are described or shown in this application for the sake of clarity. It is understood that in the development of an actual implementation incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill the art having benefit of this disclosure.

While compositions and methods are described herein in terms of "comprising" various components or steps, the compositions and methods can also "consist essentially of" or "consist of" the various components and steps. When "comprising" is used in a claim, it is open-ended. When "comprising" is used in the disclosure, it is open-ended.

Embodiments disclosed herein include:

A. An assembly, comprising: a base pipe having at least one flow port defined therein; a well screen arranged about the base pipe and in fluid communication with the at least one flow port, the well screen having an end disposed at or near the at least one flow port; a shroud arranged about the end of the well screen and extending axially along a length of the well screen; and an annular gap defined between the well screen and the shroud and configured to receive a flow of a fluid, wherein the shroud increases a flow resistance of the fluid by channeling the fluid across the annular gap to distribute a flow energy of the fluid over the length of the well screen.

B. An assembly, comprising: a base pipe having at least one flow port defined therein; a well screen arranged about the base pipe and in fluid communication with the at least one flow port; and a shroud arranged about the well screen adjacent the at least one flow port, the shroud having an uphole extension extending axially away from the at least one flow port over a first length of the well screen and a downhole extension extending axially away from the at least one flow port over a second length of the well screen; an uphole annular gap defined between the well screen and the uphole extension; and a downhole annular gap defined between the well screen and the downhole extension, wherein the uphole and downhole annular gaps are configured to receive a flow of a fluid, and wherein the uphole and downhole extensions increase a flow resistance of the fluid by channeling the fluid across the uphole and downhole annular gaps, respectively, to distribute a flow energy of the fluid over the first and second lengths of the well screen, respectively.

C. A method comprising: introducing into a wellbore a flow distribution assembly arranged on a base pipe having at least one flow port defined therein, the flow distribution assembly including a well screen arranged about the base pipe and in fluid communication with the at least one flow port, the well screen having an end disposed at or near the at least one flow port and a shroud arranged about the end of the well screen and extending axially along a length of the well screen; channeling a flow of a fluid into an annular gap defined between the well screen and the shroud; and increasing a flow resistance of the fluid by distributing a flow energy of the fluid over the length of the well screen with the shroud.

D. A method comprising: introducing into a wellbore a flow distribution assembly arranged on a base pipe having at least one flow port defined therein, the flow distribution assembly including a well screen arranged about a base pipe and in fluid communication with the at least one flow port, and a shroud arranged about the well screen adjacent to the at least one flow port, the shroud having an uphole extension extending axially away from the at least one flow port over a first length of the well screen and a downhole extension extending axially away from the at least one flow port over a second length of the well screen; channeling a flow of a fluid into an uphole annular gap defined between the well screen and the uphole extension and into a downhole annular gap defined between the well screen and the downhole extension; an annular gap defined between the well screen and the shroud; and increasing a flow resistance of the fluid by distributing a flow energy of the fluid over the first length and the second length of the well screen with the shroud.

Each of embodiments A, B, C, and D may have one or more of the following additional elements in any combination:

Element 1: Further comprising at least one flow control device arranged at or near the at least one flow port.

Element 2: Wherein the shroud further comprises at least one of a perforation and a dimple.

Element 3: Wherein the shroud comprises a plurality of perforations increasing in frequency in a direction away from the at least one flow port.

Element 4: Wherein the shroud comprises a plurality of perforations that exhibit more than one size.

Element 5: Wherein the shroud comprises a plurality of dimples increasing in frequency in a direction toward the at least one flow port.

Element 6: Wherein the shroud comprises a plurality of dimples that exhibit more than one size.

Element 7: Further comprising mesh arranged within at least a portion of the annular gap.

Element 8: Wherein the shroud tapers in a direction toward the at least one flow port.

Element 9: Wherein the shroud tapers in a direction toward the at least one flow port, and wherein tapering of the shroud is at least one of continuous and stepped.

Element 10: Wherein the shroud further comprises: an upper support coupled to the well screen uphole from the at least one flow port; and a lower support coupled to the well screen downhole from the at least one flow port.

Element 11: Wherein a portion of the well screen between the upper support and the lower support is removed.

Element 12: Wherein the upper support includes a first flow control device and the lower support includes a second flow control device.

Element 13: Further comprising plugging material disposed on either side of the at least one flow port beneath the upper support and the lower support.

Element 14: Wherein at least one of the uphole extension and the downhole extension of the shroud further comprise at least one of a perforation and a dimple.

Element 15: Wherein at least one of the uphole extension and the downhole extension of the shroud further comprise a plurality of perforations increasing in frequency in a direction away from the at least one flow port.

Element 16: Wherein at least one of the uphole extension and the downhole extension of the shroud further comprise a plurality of perforations that exhibit more than one size.

Element 17: Wherein at least one of the uphole extension and the downhole extension of the shroud further comprise a plurality of dimples increasing in frequency in a direction toward the at least one flow port.

Element 18: Wherein at least one of the uphole extension and the downhole extension of the shroud further comprise a plurality of dimples that exhibit more than one size.

Element 19: Further comprising mesh arranged within at least a portion of at least one of the uphole annular gap and the downhole annular gap.

Element 20: Wherein at least one of the uphole extension and the downhole extension of the shroud tapers in a direction toward the at least one flow port.

Element 21: Wherein at least one of the uphole extension and the downhole extension of the shroud tapers in a direction toward the at least one flow port, and wherein tapering of at least one of the uphole extension and the downhole extension is at least one of continuous and stepped.

Element 22: Wherein the shroud further comprises at least one of a perforation and a dimple, the method further comprising further increasing the flow resistance of the fluid as the fluid traverses the perforation and/or the dimple.

Element 23: Further comprising mesh arranged within at least a portion of the annular gap, the method further comprising further increasing the flow resistance of the fluid as the fluid traverses the mesh.

Element 24: Wherein the shroud tapers in a direction toward the at least one flow port, the method further comprising further increasing the flow resistance of the fluid as the fluid traverses the shroud as it tapers in the direction toward the at least one flow port.

Element 25: Further comprising arranging at least one flow control device at or near the at least one flow port.

Element 26: Wherein at least one of the uphole extension and the downhole extension of the shroud further comprises at least one of a perforation and a dimple, the method further comprising further increasing the flow resistance of the fluid as the fluid traverses the perforation and/or the dimple.

Element 27: Further comprising mesh arranged within at least a portion of at least one of the uphole annular gap and the downhole annular gap, the method further comprising further increasing the flow resistance of the fluid as the fluid traverses the mesh.

Element 28: Wherein at least one of the uphole extension and the downhole extension tapers in a direction toward the at least one flow port, the method further comprising further increasing the flow resistance of the fluid as the fluid traverses the shroud as it tapers in the direction toward the at least one flow port.

Element 29: Wherein the shroud further comprises an upper support and a lower support, the method further comprising coupling the upper support to the well screen uphole from the at least one flow port and the lower support to the well screen downhole from the at least one flow port.

By way of non-limiting example, exemplary combinations applicable to A, B, C, and D include: A with 1, 8, and 9; A with 5 and 7; B with 10, 11, 14, and 20; B with 13 and 21; C with 22 and 23; C with 24 and 25; D with 29; and D with 27 and 28.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. An assembly, comprising:

a base pipe having at least one flow port defined therein;

a well screen arranged about the base pipe and in fluid communication with the at least one flow port, the well screen having an end disposed at or near the at least one flow port;

a shroud arranged about the end of the well screen; wherein the shroud further comprises: an upper support coupled to the well screen uphole from the at least one flow port and a lower support coupled to the well screen downhole from the at least one flow port; wherein a portion of the well screen between the upper support and the lower support is removed; and an annular gap defined between the well screen and the shroud and configured to receive a flow of a fluid, wherein the shroud increases a flow resistance of the fluid by channeling the fluid across the annular gap to distribute a flow energy of the fluid over the length of the well screen.

2. The assembly of claim 1, wherein the shroud further comprises at least one of a perforation and a dimple.

3. The assembly of claim 1, wherein the shroud comprises a plurality of perforations and/or dimples that exhibit more than one size.

4. The assembly of claim 1, wherein the shroud comprises a plurality of perforations increasing in frequency in a direction away from the at least one flow port.

5. The assembly of claim 1, wherein the shroud comprises a plurality of dimples increasing in frequency in a direction toward the at least one flow port.

6. The assembly of claim 1, wherein the shroud tapers in a direction toward the at least one flow port.

7. The assembly of claim 6, wherein tapering of the shroud is at least one of continuous and stepped.

8. An assembly, comprising:

a base pipe having at least one flow port defined therein;

a well screen arranged about the base pipe and in fluid communication with the at least one flow port, the well screen having an end disposed at or near the at least one flow port;

a shroud arranged about the end of the well screen and extending axially along a length of the well screen; wherein the shroud further comprises: an upper support coupled to the well screen uphole from the at least one flow port and a lower support coupled to the well screen downhole from the at least one flow port; wherein the upper support includes a first flow control device and the lower support includes a second flow control device; and an annular gap defined between the well screen and the shroud and configured to receive a flow of a fluid, wherein the shroud increases a flow resistance of the fluid by channeling the fluid across the annular gap to distribute a flow energy of the fluid over the length of the well screen.

9. The assembly of claim 8, wherein the shroud further comprises at least one of a perforation and a dimple.

10. The assembly of claim 8, wherein the shroud comprises a plurality of perforations and/or dimples that exhibit more than one size.

11. The assembly of claim 8, wherein the shroud comprises a plurality of perforations increasing in frequency in a direction away from the at least one flow port.

12. The assembly of claim 8, wherein the shroud comprises a plurality of dimples increasing in frequency in a direction toward the at least one flow port.

13. The assembly of claim 8, wherein the shroud tapers in a direction toward the at least one flow port.

14. The assembly of claim 13, wherein tapering of the shroud is at least one of continuous and stepped.

15. An assembly, comprising:

a base pipe having at least one flow port defined therein;

a well screen arranged about the base pipe and in fluid communication with the at least one flow port, the well screen having an end disposed at or near the at least one flow port;

a shroud arranged about the end of the well screen and extending axially along a length of the well screen; wherein the shroud further comprises: an upper support coupled to the well screen uphole from the at least one flow port and a lower support coupled to the well screen downhole from the at least one flow port;

plugging material disposed on either side of the at least one flow port beneath the upper support and the lower support; and an annular gap defined between the well screen and the shroud and configured to receive a flow of a fluid, wherein the shroud increases a flow resistance of the fluid by channeling the fluid across the annular gap to distribute a flow energy of the fluid over the length of the well screen.

16. The assembly of claim 15, wherein the shroud further comprises at least one of a perforation and a dimple.

17. The assembly of claim 15, wherein the shroud comprises a plurality of perforations and/or dimples that exhibit more than one size.

18. The assembly of claim 15, wherein the shroud comprises a plurality of perforations increasing in frequency in a direction away from the at least one flow port.

19. The assembly of claim 15, wherein the shroud comprises a plurality of dimples increasing in frequency in a direction toward the at least one flow port.

20. The assembly of claim 15, wherein the shroud tapers in a direction toward the at least one flow port.

* * * * *